US008907749B2

(12) United States Patent
Pajovic

(10) Patent No.: US 8,907,749 B2
(45) Date of Patent: Dec. 9, 2014

(54) GIGAHERTZ COMMON-MODE FILTER FOR MULTI-LAYER PLANAR STRUCTURE

(75) Inventor: Miroslav Pajovic, Sunnyvale, CA (US)

(73) Assignee: Cisco Technology, Inc., San Jose, CA (US)

( * ) Notice: Subject to any disclaimer, the term of this patent is extended or adjusted under 35 U.S.C. 154(b) by 311 days.

(21) Appl. No.: 13/424,914

(22) Filed: Mar. 20, 2012

(65) Prior Publication Data

US 2013/0249652 A1 Sep. 26, 2013

(51) Int. Cl.
*H01P 1/203* (2006.01)
*H01P 7/08* (2006.01)

(52) U.S. Cl.
CPC .. *H01P 1/203* (2013.01); *H01P 7/08* (2013.01)
USPC ..... 333/204; 333/219

(58) Field of Classification Search
CPC ..... H01P 1/2005; H01P 1/20363; H01P 1/20354; H01P 7/08; H01P 7/082
USPC ..... 333/4, 5, 12, 202, 204, 219, 205, 235
See application file for complete search history.

(56) References Cited

U.S. PATENT DOCUMENTS

| | | | | |
|---|---|---|---|---|
| 8,339,212 | B2 * | 12/2012 | Wu et al. | 333/12 |
| 8,570,114 | B2 * | 10/2013 | Wu et al. | 333/12 |
| 2007/0024399 | A1 * | 2/2007 | Martin Antolin et al. | 333/205 |
| 2010/0073109 | A1 * | 3/2010 | Wu et al. | 333/205 |

OTHER PUBLICATIONS

Dallas Semiconductor Maxim, "Application Note 2045 Understanding Common-Mode Signals", May 21, 2003 (11 pages).

* cited by examiner

*Primary Examiner* — Robert Pascal
*Assistant Examiner* — Gerald Stevens
(74) *Attorney, Agent, or Firm* — Brinks Gilson & Lione

(57) ABSTRACT

An apparatus includes a filter that includes a multi-layer planar structure having a first layer and a second layer. The first layer includes an electronic band-gap structure that is configured to suppress a first frequency component of signals passing through the filter. The second layer includes a quarter-wavelength stub that is configured to suppress a second frequency component of the signals passing through the filter.

18 Claims, 6 Drawing Sheets

GIGAHERTZ COMMON-MODE FILTER FOR MULTI-LAYER PLANAR STRUCTURE

FIELD

The present embodiments relate to filters and more particularly to a filter that includes a multi-layer planar structure that is configured to filter common mode noise at Gigahertz harmonic frequencies.

BACKGROUND

Differential transmission lines may be used to achieve low electromagnetic interference (EMI) emissions, better signal integrity, and better data quality for high-speed digital signals. However, undesired and harmful common-mode noise may propagate along the differential transmission lines. Common-mode nose may be especially problematic at high frequencies, such as Gigahertz frequencies.

DESCRIPTION OF EXAMPLE EMBODIMENTS

Overview

Figure 1:
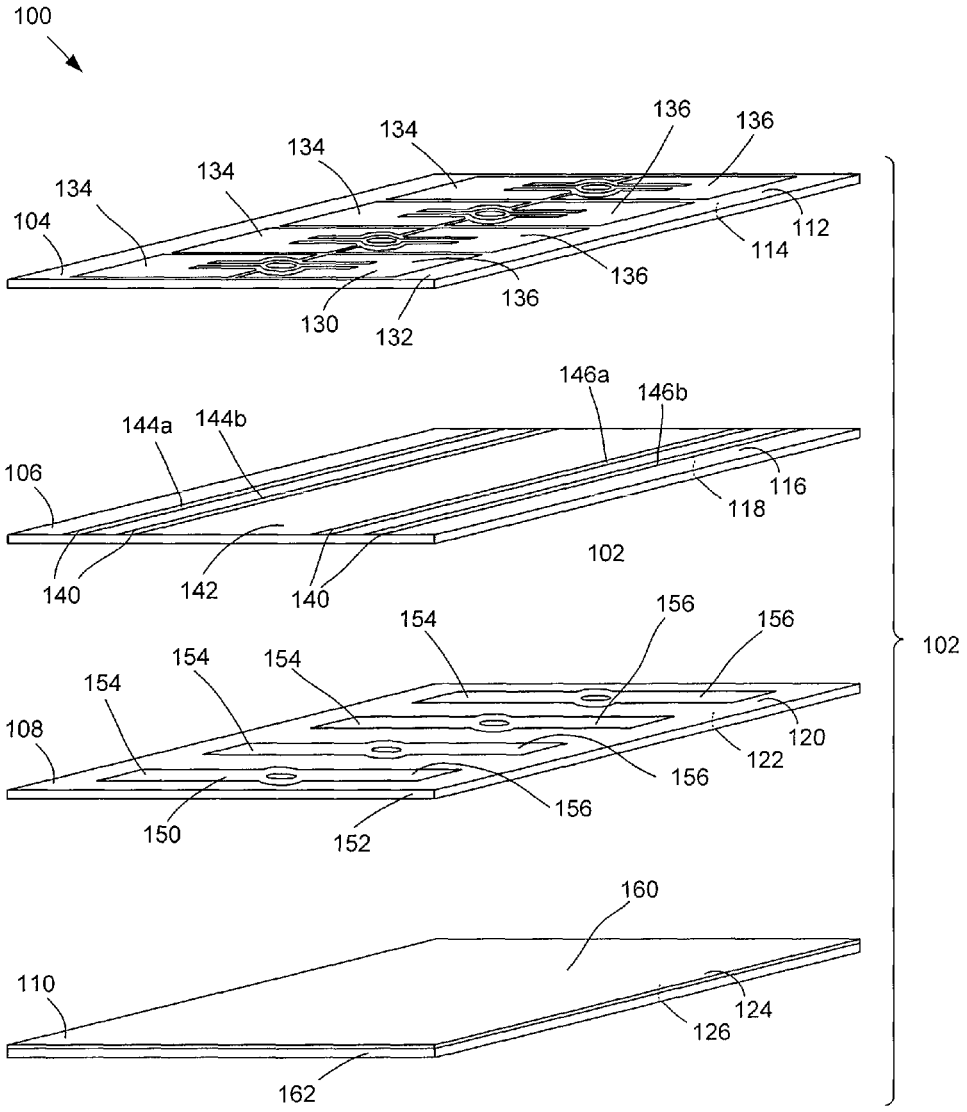
FIG. 1 illustrates an exploded perspective view of an example apparatus having a filter implemented in a multi-layer planar structure.

An apparatus may include a filter having a multi-layer planar structure. The multi-layer planar structure may include a first layer that has an electromagnetic band-gap (EBG) structure. The EBG structure may be configured to suppress a first frequency component of signals passing through the filter. The multi-layer planar structure may also include a second layer that has a quarter wavelength stub. The quarter wavelength stub may be configured to suppress a second frequency component of the signals passing through the filter. The multi-layer planar structure may further include a third layer that has a differential transmission line configured to transmit the signals passing through the filter.

Example Embodiments

The present disclosure describes an apparatus that includes a filter that is configured to suppress at least two frequency components or ranges of frequency components of signals passing through the filter. A frequency component of a signal may be a portion, part, or component of the signal that oscillates at a particular frequency. The filter may be a band-stop filter. The filter may include and/or be implemented in or as a multi-layer planar structure that includes multiple layers. Example multi-layer planar structures may include an integrated circuit (IC) package or a printed circuit board (PCB). A first layer of the multi-layer planar structure may include one or more first filter components that are configured to suppress a first frequency component or a first range of frequency components (hereinafter referred to collectively as "first frequency component"). A second layer of the multi-layer planar structure may include one or more second filter components that are configured to suppress a second frequency component or a second range of frequency components (herein after referred to collectively as "second frequency component"). The first filter components may include electromagnetic band-gap (EBG) structures, also known as a high-impedance surface structures. The EBG structures may be mushroom-type or mushroom-like EBG structures, although other types of EBG structures may be used. The second filter components may include end-closed quarter-wavelength stubs or transmission lines. A frequency, such as a center frequency, of the band-stop filter may be associated with high input filter impedance at an anti-resonance frequency of the end-closed stub. The length of the end-closed stub may be equal to one-quarter of the wavelength that is related and/or associated with the center or anti-resonance frequency. The multi-layer planar structure may further include a third layer that has at least one pair of differential transmission lines that are configured to transmit a signal, such as a differential signal. The multi-layer planar structure may also include a fourth layer that is configured as a ground or reference plane.

In some example configurations and/or implementations, the filter may be configured to suppress electromagnetic interference (EMI) transmissions caused by common-mode noise that propagates along differential lines. The common-mode noise may occur at harmonic frequencies, such as those associated with a data rate of digital differential signals being transmitted along the differential transmission line. The n-th order harmonic frequencies, such as fundamental harmonic, second-order harmonic, and/or third-order harmonic frequencies as examples. For example, a differential signal being transmitted at a data rate of ten Gigabytes per second (10 Gb/s) may have an associated common mode noise generated at harmonic frequencies, including a fundamental harmonic frequency of 10.3 Gigahertz (GHz) and a second-order or a second harmonic frequency of 20.6 GHz. In some example applications, the common mode noise may be generated in input/output (I/O) buffers and/or PCB differential transmission lines when, for example, differential signals are skewed in time and/or unbalanced in amplitude and/or rise-and-fall times. Also, I/O ports and I/O cables may act as efficient slot and wire antennas for common mode noise. The filter may be configured to suppress the common-mode noise having frequency components at the harmonic frequencies associated with the data rate. The harmonic frequency components may be suppressed with minimal degradation of the differential-mode signals being transmitted along the differential transmission line.

FIG. 1 shows an exploded perspective view of an example apparatus 100 that includes a filter 102 that is configured to suppress at least two frequency components or ranges of frequency components of signals passing through the filter 102. The filter 102 may include and/or be implemented in or as a multi-layer planar structure that includes multiple layers, including a first layer 104, a second layer 106, a third layer 108, and a fourth layer 110. The layers 104-110 may be planar structures and may be in alignment with and/or positioned parallel or substantially parallel to each other. Each of the layers 104-110 may have opposing planar surfaces. For example, the first layer 104 may have a top planar surface 112 that opposes a bottom planar surface 114. The second layer 106 may have a top planar surface 116 that opposes a bottom planar surface 118. The third layer 108 may have a top planar surface 120 that opposes a bottom planar surface 122. The fourth layer 110 may have a top planar surface 124 that opposes a bottom planar surface 126. Herein, the terms "top" and "bottom" are used to describe the relative position of the layers in the embodiments. However, these terms should not be construed as limiting the relative positioning of the layers since the layers as a group can be in any orientation resulting in substantially parallel positioning between the layers.

Each of the layers 104-110 may include a metal sub-layer that is affixed to a substrate sub-layer, such as through lamination as an example. The metal sub-layers may be made of a conductive material, such as copper. The substrate sub-layers may be made of an electrically insulating and/or dielectric material, such as polytetrafluoroethylene (Teflon), FR-4, FR-1, CEM-1, or CEM-3 as examples. The material of the substrate sub-layers may be used based on the dielectric constant of the material. In one example, the substrate sub-layers may have a dielectric constant of four, although substrate materials having other dielectric constants may be used. The layers 104-110 may be affixed, such as laminated, to each other using various adhesives, such an epoxy resin prepreg for example.

The first layer 104 may have a first metal sub-layer 130 disposed on and/or affixed to a first substrate sub-layer 132 of the first layer 104. In one example configuration, the first metal sub-layer 130 may be affixed to the top planar surface 112, which opposes the bottom planar surface 114 facing the second layer 106. The first metal-sub-layer 130 may include one or more filter components 134, 136 that are configured to suppress at least one first frequency component of signals passing through the PCB filter 102 on differential transmission lines 144, 146 disposed on the second layer 106. The first filter components 134, 136 may be electromagnetic band-gap (EBG) structures or EBG cells 134, 136. Where the first layer 104 includes multiple EBG cells 134, 136, the EBG cells 134, 136 may be configured as an array or arrays of EBG cells 134, 136. In addition, each of the EBG cells 134, 136 may be configured to suppress the at least one first frequency component of signals for one of the differential transmission lines 144, 146. The one differential transmission line may be the differential transmission line with which the EGB cells are aligned. For example, the EGB cells 134 may be aligned with the differential transmission line 144 and may also be configured to suppress the at least one first frequency component of signals propagating along the differential transmission line 144. Similarly, the EBG cells 136 may be aligned with the differential transmission line 146 and may also be configured to suppress the at least one first frequency component of signals propagating along the differential transmission line 146.

In some example configurations, where one but not both of the differential transmission lines 144, 146 are included on the second layer 106, then the EBG cells that are aligned with the included differential transmission line may be included in the first layer 104, but not the EBG cells that are not aligned with the differential transmission line that is included. For example, if the differential transmission line 144 is included on the second layer 106 but not the differential transmission line 146, then the EBG cells 134 may be included on the first layer 104, but not the EBG cells 136. Alternatively, if the transmission line 146 is included on the second layer 106, but not the differential transmission line 144, then the EBG cells 136 may be included on the first layer 104, but not the EBG cells 134.

The second layer 106 may include a second metal sub-layer 140 disposed on and/or affixed to a second substrate sub-layer 142 of the second layer 106. In one example configuration, the second metal sub-layer may be affixed to the top planar surface 116, which faces the bottom planar surface 114 of the first layer 104. The second metal sub-layer may include at least one of the differential transmission lines 144, 146. In some example configurations, the transmission lines 144, 146 may configured as part of different signal paths. For example, the transmission line 144 may be and/or be part of a transmit signal path and the transmission line 146 may be and/or be part of a receive signal path, or vice versa. Various configurations are possible.

The differential transmission lines 144, 146 may be configured to have a differential characteristic impedance of a predetermined amount, such as 100 ohms, although other characteristic impedances may be used. The differential transmission lines may include a pair of differential traces. For example, the differential transmission line 144 may include differential traces 144*a*, 144*b*. Similarly, the differential transmission line 146 may include differential traces 146*a*, 146*b*. The differential transmission lines 144, 146 may be configured to transmit differential signals. The differential signals may be digital differential signals configured to propagate along the differential transmission lines 144, 146 at a predetermined digital data rate. The digital data rate may be on an order of Gb/s, such as 10 Gb/s, although other digital data rates may be used.

The third layer 108 may have a third metal sub-layer 150 disposed on and/or affixed to a third substrate sub-layer 152 of the third layer 108. In one example configuration, the third metal sub-layer 150 may be affixed to the top planar surface 120, which faces the bottom planar surface 118 of the second layer 106. The second metal-sub-layer 150 may include one or more second filter components 154, 156 that are configured to suppress at least one second frequency component of signals passing through the PCB filter 102. The second filter component 154 may include one or more quarter wavelength stubs 154, 156, such as one or more end-closed quarter wavelength stubs 154, 156. Where the third layer 108 includes multiple quarter wavelength stubs 154, 156, the quarter wavelength stubs 154, 156 may be configured as an array or arrays of quarter wavelength stubs 154, 156 and/or as a periodic filter (or periodic common-mode filter) for suppressing the at least one second frequency component. The quarter wavelength stubs 154, 156 may introduce high-impedance for common-mode currents at the frequency of the second frequency component.

In addition, each of the quarter wavelength stubs 154, 156 may be configured to suppress the at least one second frequency component of signals for one of the differential transmission lines 144, 146. The one differential transmission line may be the differential transmission line with which the quarter wavelength stubs are aligned. For example, the quarter wavelength stubs 154 may be aligned with the differential transmission line 144 and may also be configured to suppress the second frequency component of signals propagating along the differential transmission line 144. Similarly, the quarter wavelength stubs 156 may be aligned with the differential transmission line 146 and may also be configured to suppress the second frequency component of signals propagating along the differential transmission line 146.

In some example configurations, where one but not both of the differential transmission lines 144, 146 are included on the second layer 106, then the quarter wavelength stubs that are aligned with the included differential transmission line may be included in the third layer 108, but not the quarter wavelength stubs that are not aligned with the differential transmission line that is included. For example, if the differential transmission line 144 is included on the second layer 106 but not the differential transmission line 146, then the quarter wavelength stubs 154 may be included on the third layer 108, but not the quarter wavelength stubs 156. Alternatively, if the transmission line 146 is included on the second layer 106, but not the differential transmission line 144, then the quarter wavelength stubs 156 may be included on the third layer 108, but not the quarter wavelength stubs 154.

A number of quarter wavelength stubs 154, 156 may be equal to a number of EBG cells 134, 136. Additionally, each differential transmission line 144, 146 may be associated and/or aligned with the same amount of EBG cells as it is associated and/or aligned with quarter wavelength stubs. For example, as shown in FIG. 1, the PCB filter 102 may have eight quarter wavelength stubs 154, 156 and eight EBG cells 134, 136. The differential transmission line 144 may be associated and/or aligned with four EBG cells 134 and four quarter wavelength stubs 154. Similarly, the differential transmission line 146 may be associated and/or aligned with four EBG cells 136 and four quarter wavelength stubs 156.

In alternative example configurations, the number of quarter wavelength stubs 154, 156 may be different than the number of EGB cells 134, 136. For example, the number of quarter wavelength stubs 154, 156 may be greater than the number of EBG cells 134, 136. Alternatively, the number of quarter wavelength stubs 154, 156 may be less than the number of EGB cells 134, 136.

In addition or alternatively, at least some of the quarter wavelength stubs 154, 156 may be in alignment with at least some of the EBG cells 134, 136. In one example configuration, as shown in FIG. 1, each quarter wavelength stub 154, 156 may be in alignment with a respective EBG cell 134, 136. The quarter wavelength stubs 154, 156 may be aligned with the EBG cells 134, 136 so that vias (described in more detail with respect to FIGS. 5 and 6) extending from the first layer 104 to the third layer 108 may electrically connect the EBG cells 134, 136 with respective quarter wavelength stubs 154, 156.

As previously described, in the example configuration shown in FIG. 1, each transmission line 144, 146 may be associated with a predetermined number, such as four EBG cells 134, 136 and a predetermined number, such as four quarter wavelength stubs 154, 156. Otherwise stated, the PCB filter 102 may include a predetermined number, such as four EBG cells per differential transmission line and four quarter wavelength stubs per differential transmission line. The predetermined ratio, such as a four-to-one ratio between EBG cells and differential transmission lines and/or between quarter wavelength stubs and differential transmission lines may remain constant as more or fewer differential transmission lines are included in the apparatus. For example, where an alternative apparatus includes three differential transmission lines or four differential transmission lines, the alternative apparatus may include twelve EBG cells and twelve quarter wavelength stubs, or sixteen EBG cells and sixteen quarter wavelength stubs, respectively.

Other amounts of EBG cells and/or quarter wavelength stubs per differential transmission line may be included. For example, the PCB filter 102 may include a three-to-one ratio or a five-to-one ratio between EBG cells and differential transmission lines and/or between quarter wavelength stubs and differential transmission lines. In general, the fewer the number of EBG cells and/or quarter wavelength stubs, the less the PCB filter 102 may suppress the first frequency component and/or the second frequency component of signals passing through the filter 102. Similarly, the greater the number of EBG cells and/or quarter wavelength stubs, the more the PCB filter 102 may suppress the first frequency component and/or the second frequency component of signals passing through the filter 102. In some example configurations, four EBG cells per differential transmission line and four quarter wavelength stubs per differential transmission line may be an optimal ratio in terms of the amount that the first and second frequency components are suppressed and the size of the apparatus 100. Other ratios may be optimal and/or determined based on size requirements, performance requirements, and/or application requirements of the application in which the apparatus 100 and/or the filter 102 may be used, as examples.

The fourth layer 106 may include a fourth metal sub-layer 160 disposed on and/or affixed to a fourth substrate sub-layer 162 of the fourth layer 110. In one example configuration, the fourth metal sub-layer 160 may form the top planar surface 124 and/or may face the bottom planar surface 122 of the third layer 106. The fourth metal sub-layer may include a reference (ground) plane, which may include a sheet of metal, such as copper, that covers or substantially covers a planar surface of the fourth substrate sub-layer 162 that faces toward the third layer 108.

FIG. 1 shows one example arrangement or configuration of the layers 104-110. Alternative apparatuses may arrange or configure the layers 104-110 in any numbers of various configurations or arrangement. As an example, the first layer 104 may have quarter wavelength stubs and the third layer 108 may have EBG cells. In addition or alternatively, the quarter wavelength stubs and the EBG cells may be "mix-and-matched." For example, each of the first layer 104 and the third layer 108 may have two EBG cells and two quarter wavelength stubs. Various configurations are possible.

Figure 2:
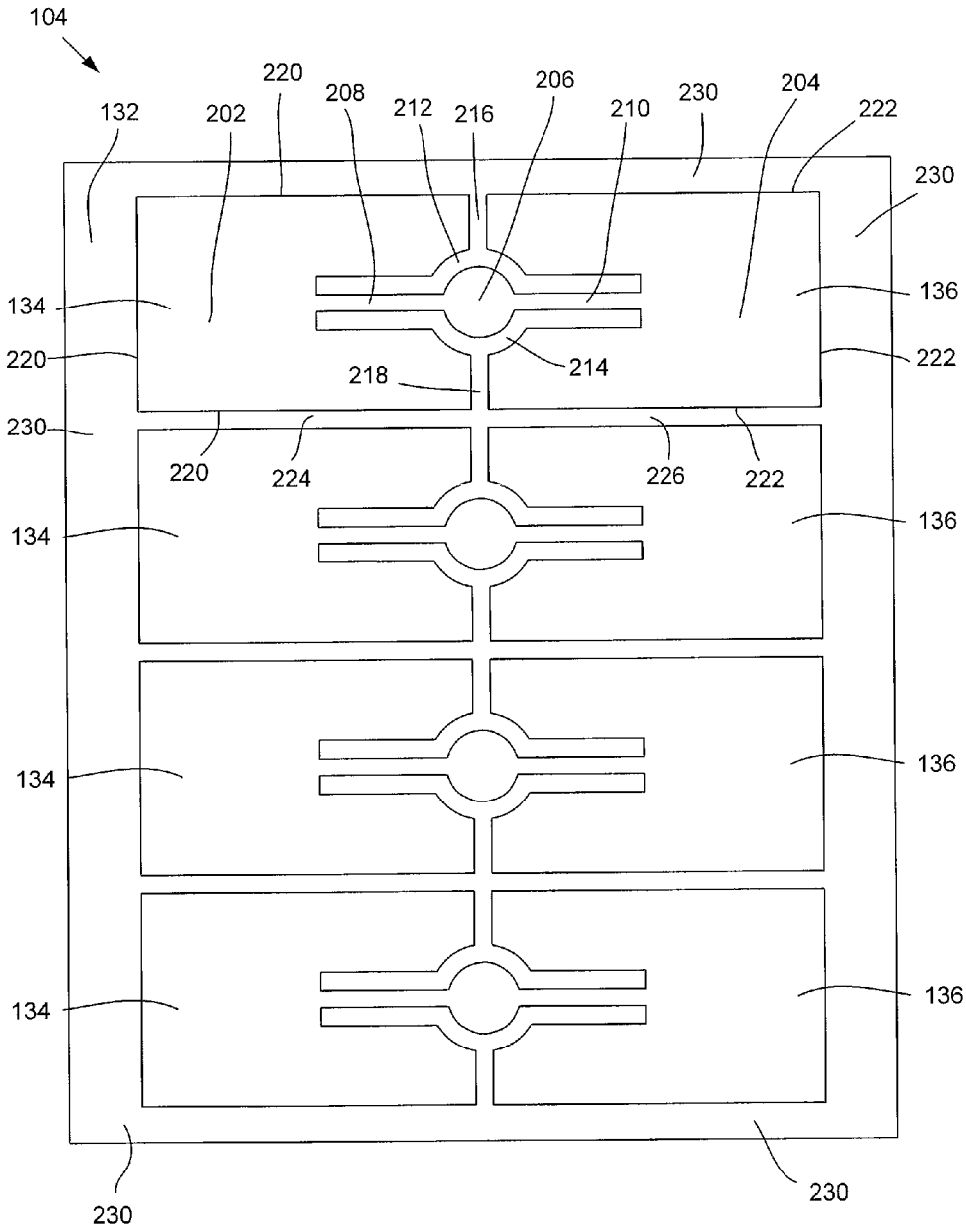
FIG. 2 illustrates a top view of a layer of an example multi-layer planar structure, showing an array of electromagnetic band-gap structures.

FIG. 2 shows a top view of the first layer 104 of the apparatus 100 shown in FIG. 1. FIG. 2 shows an array of the EBG cells 134 and an array of the EBG cells 136, affixed to the substrate sub-layer 132. Each EBG cell 134 and EBG cell 136 may have the same or substantially the same dimensions and/or be symmetrical to each other. Additionally, where there are two differential transmission lines 144, 146 as shown in FIG. 1, each EBG cell 134 may have a corresponding and/or an opposing EBG cell 136. The EBG cells 134 may be separated from and/or unconnected with their corresponding and/or opposing EBG cell 136 except where the EBG cells 134, 136 are connected to a common via 206.

Each EBG cell 134, 136 may have a main portion 202, 204 and an inductive stripe 208, 210 that extends from their respective main portion 202, 204 and is connected to the via 206. The main portion 202 may be unconnected with the via 206 except where the inductive stripe 208 is connected to the via 206. Similarly, the main portion 204 may be unconnected with the via 206 except where the inductive stripe 210 is connected to the via 206.

In addition, 212 and 214 may extend the lengths of the inductive stripes 208, 210 and surround the via 206 except where the inductive stripes 208, 210 are connected to the via 206. The gaps 212, 214 may define and/or determine the dimensions of the inductive stripes 208, 210. The gaps 208, 210 may also separate the main portion 202 and the main portion 204 from the via 206, except where the inductive stripes 208, 210 are connected to the via 206.

In addition, gaps 216, 218 may extend from portions of the gap 212, 214 to outer perimeters 220, 222 of the EBG cells 134. The gaps 216, 218 may extend in opposite directions from the gaps 212, 214 to opposing sides of the outer perimeters 220, 222 of the EBG cells 134, 136. Additionally, the gaps 216, 218 may extend in directions that are perpendicular to a direction in which the stripes 208, 210 extend. The gaps 212-218 may separate and/or disconnect the main portion 202 from the main portion 204.

In addition, as shown in FIG. 2, a gap 224 may be disposed in between adjacent EBG cells 134, separating the main portion 202 of one EBG cell 134 from a main portion 202 an adjacent EBG cell 134. Similarly, a gap 226 may be disposed in between adjacent EBG cells 136, separating the main portion 204 of one EBG cell 136 from a main portion 204 of an adjacent EBG cell 136. In addition, as shown in FIG. 2, the EBG cells 134, 136 may not extend to the sides or edges of the first substrate sub-layer 132, such that an area 230 of the first substrate sub-layer 132 surrounding the EBG cells 134, 136 may be exposed and/or uncovered by the EBG cells 134, 136.

Figure 3:
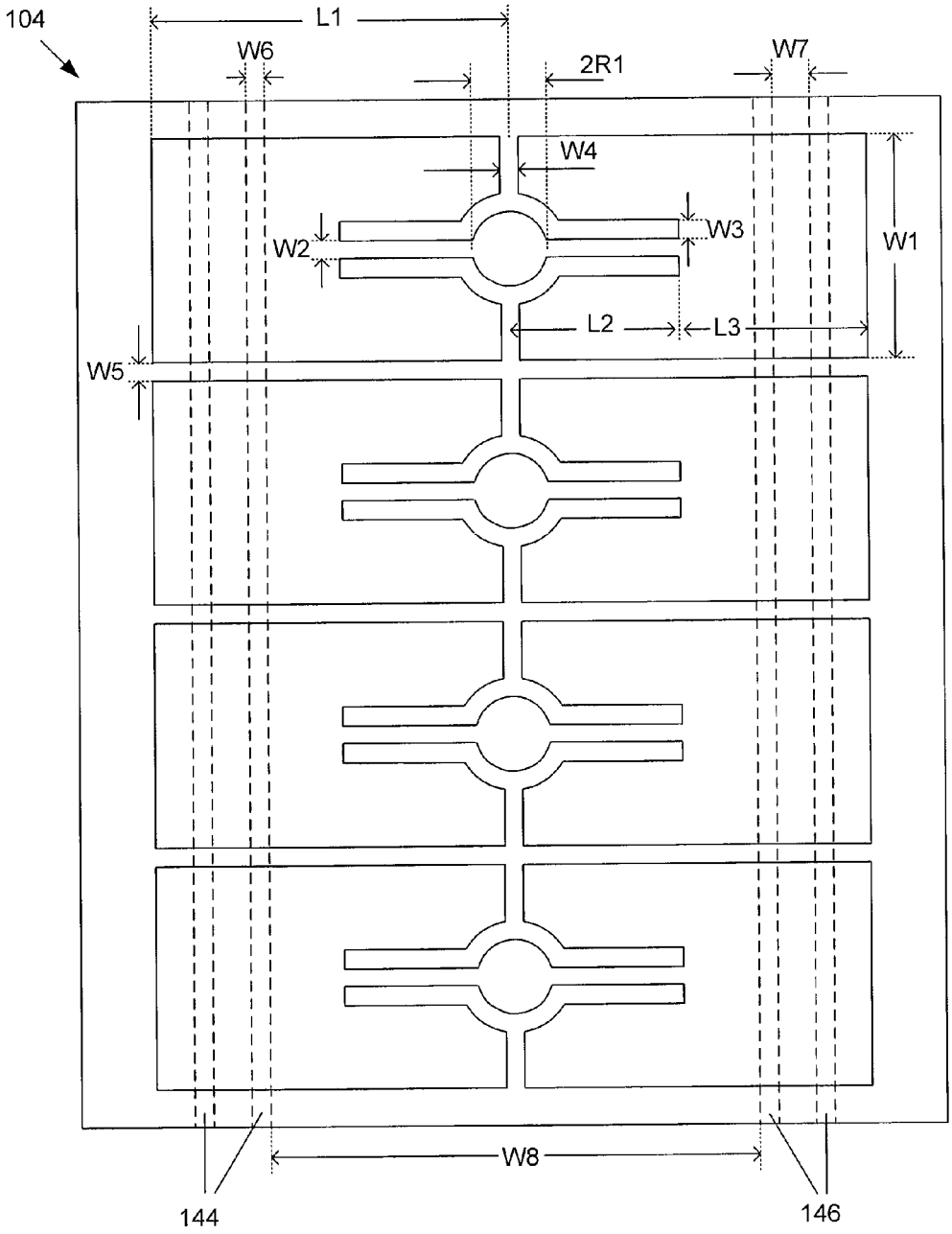
FIG. 3 illustrates an example of a top view of a layer of a multi-layer planar structure, showing various dimensions of electromagnetic band-gap structures.

FIG. 3 shows various dimensions that may be used to define, describe, and/or characterize the EBG cells 134, 136 and/or their orientation with relation to opposing EBG cells or to adjacent EBG cells. The dimensions may include a length L1 and a width W1 of the main portions 202, 204. The dimensions may also include a width W2 of the inductive stripes 208, 210 and/or a length L2 defining a length or distance from where the inductive stripes 208, 210 extend from their main portions 202, 204 to a center of the via 206. In addition, the dimensions may include a width W3 of the gaps 212, 214, a width W4 of the gaps 216, 218, and a width W5 of the gaps 224, 226 in between adjacent EGB cells 134, 136. In some example configurations, the widths W3, W4, W5 may be equal to each other. In other example configurations, one or more of the widths W3, W4, W5 may be different from each other. The dimensions may also include a radius R1 of the via 206 and/or a distance L3 from where the inductive stripes 210, extend from their respective main portions 202, 204 to an edge or side of the respective main portions 208, 212 that are adjacent the area of the substrate 230. As shown in FIG. 3, the edges or sides defining the distance 1*p* may be edges or sides 220, 222 of the main portions 202, 204 that extend perpendicular to the direction in which the inductive stripes 208, 210 extend.

In some example configurations, as shown in FIGS. 2 and 3, the EBG cells 134, 136 may each be configured to have the same dimensions and/or be configured to suppress the same first frequency component. In alternative example configurations, the at least one first frequency component may include multiple frequency components at different frequencies. Some of the EBG cells 134, 136 may have different dimensions or be configured to suppress different frequencies than other of the EBG cells 134, 136. For example, EBG cells 134 may be configured to have different dimensions and/or suppress signals having different frequencies than EBG cells 136. In addition or alternatively, some of the EBG cells 134 may be configured to have different dimensions and/or suppress signals having different frequencies than other of the EBG cells 134. Similarly, some of the EBG cells 136 may be configured to have different dimensions and/or suppress signals having different frequencies than other of the EBG cells 136. Various configurations are possible.

FIG. 3 also shows a top view of differential transmission lines 144, 146, shown as dotted lines, in relation to the EBG cells 134. As shown in FIG. 3, the EBG cells 134 may be aligned with the differential transmission line 144 such that the main portions 202 may be aligned with the differential transmission line 144, but the inductive stripes 208 may not aligned or may be unaligned with the differential transmission line 144. Similarly, the EBG cells 136 may be aligned with the differential transmission line 146 such that the main portions 204 may be aligned with the differential transmission line 146, but the inductive stripes 210 may not be aligned or may be unaligned with the differential transmission line 146.

In some example configurations, the transmission lines 144, 146 may have the same or substantially similar dimensions. In addition, one or more dimensions may be used to define, determine, and/or characterize the differential transmission lines 144, 146. For example, each trace of the differential transmission lines 144, 146 may have a width W6. In addition, a spacing between differential traces of differential transmission line 144 and a spacing between differential traces of differential transmission line 146 may each be defined by a width W7. Additionally, a minimum length between the differential transmission line 144 and the differential transmission line 146 may be defined by a distance W8. The distance W8 may be a distance that minimizes crosstalk between the differential transmission line 144 and the differential transmission line 146.

At least some of the dimensions of the EBG cells 134, 136 may be determined by the frequency or frequencies of the at least one first frequency component to be suppressed. For example, the length L1 and the width W1 of main portions 202, 204 may be determined to be a length and width that cause the EBG cells 134, 136 to be electrically short at a frequency of the first frequency component. To illustrate, where the frequency of the first frequency component is 10 GHz, the EBG cells 134, 136 are electrically short when L1=1.6 millimeters and W1=1.2 millimeters. After the length L1 and the width W1 are determined, circuit models, including filter circuit and even-mode circuit models, for one or both of the transmission lines 144, 146 over the width W1 of an EBG cell 134, 136 may be determined. The circuit models may be used to determine various inductances and capacitance values associated with the differential transmission lines 144, 146 over the width W1 of the EBG cell 134, 136. The inductances and capacitances may include self-inductance $L_t$ of a differential trace, self-capacitance $C_t$ of a differential trace, self EBG capacitance $C_p$ with respect to the reference plane, stripe line inductance $L_5$ of the inductive stripes 208, 210, via inductance $L_v$ of the via 206, even-mode inductance $L_{te}$ of the differential transmission lines 144, 146, even-mode capacitance $C_{te}$ of the differential transmission lines 144, 146, and mutual capacitance $C_{pm}$ between two adjacent EGB cells 134 or EBG cells 136. At least some of the various inductances and capacitances may be determined using the following equations:

$$f_H \approx \frac{1}{2\pi\sqrt{(2\cdot L_S)\cdot(C_p/2)}}, \tag{1}$$

$$f_L \approx \frac{1}{2\pi\sqrt{(2\cdot L_S)\cdot(C_{te}+C_p/2)}}, \tag{2}$$

$$C_p \approx \varepsilon_0\varepsilon_r\frac{W1\cdot L1-2\cdot L2\cdot W3}{2\pi\sqrt{(2\cdot L_S)\cdot(C_{te}+C_p/2)}}, \tag{3}$$

$$L_v = \frac{\mu_0}{2\pi}h_v\left\{\ln\left[\frac{h_v}{R1}+\sqrt{\left(\frac{h_v}{R1}\right)^2+1}+\frac{R1}{h_v}-\sqrt{\left(\frac{R1}{h_v}\right)^2+1}\right]+\frac{1}{4}\right\}, \tag{4}$$

where from Equation (1), $f_H$ is a high cutoff frequency associated with a frequency of the first frequency component, and $f_L$ is a low cutoff frequency associated with the frequency of the first frequency component; from Equation (3), $\in_0$ is the vacuum permittivity or dielectric constant of free space, and $\in_r$ is the relative permittivity or relative dielectric constant of the substrate; and from Equation (4), $\mu_0$ is the permeability or magnetic constant of free space, $h_v$ is the height of the via 206. In one example, for EBG cells 134 configured to suppress signal components having a frequency of 10 GHz, the high cutoff frequency $f_H$ may be 10.8 GHz, and the low cutoff frequency $f_L$ may be 9.65 GHz. Other high and low cutoff frequencies are possible.

Figure 4:
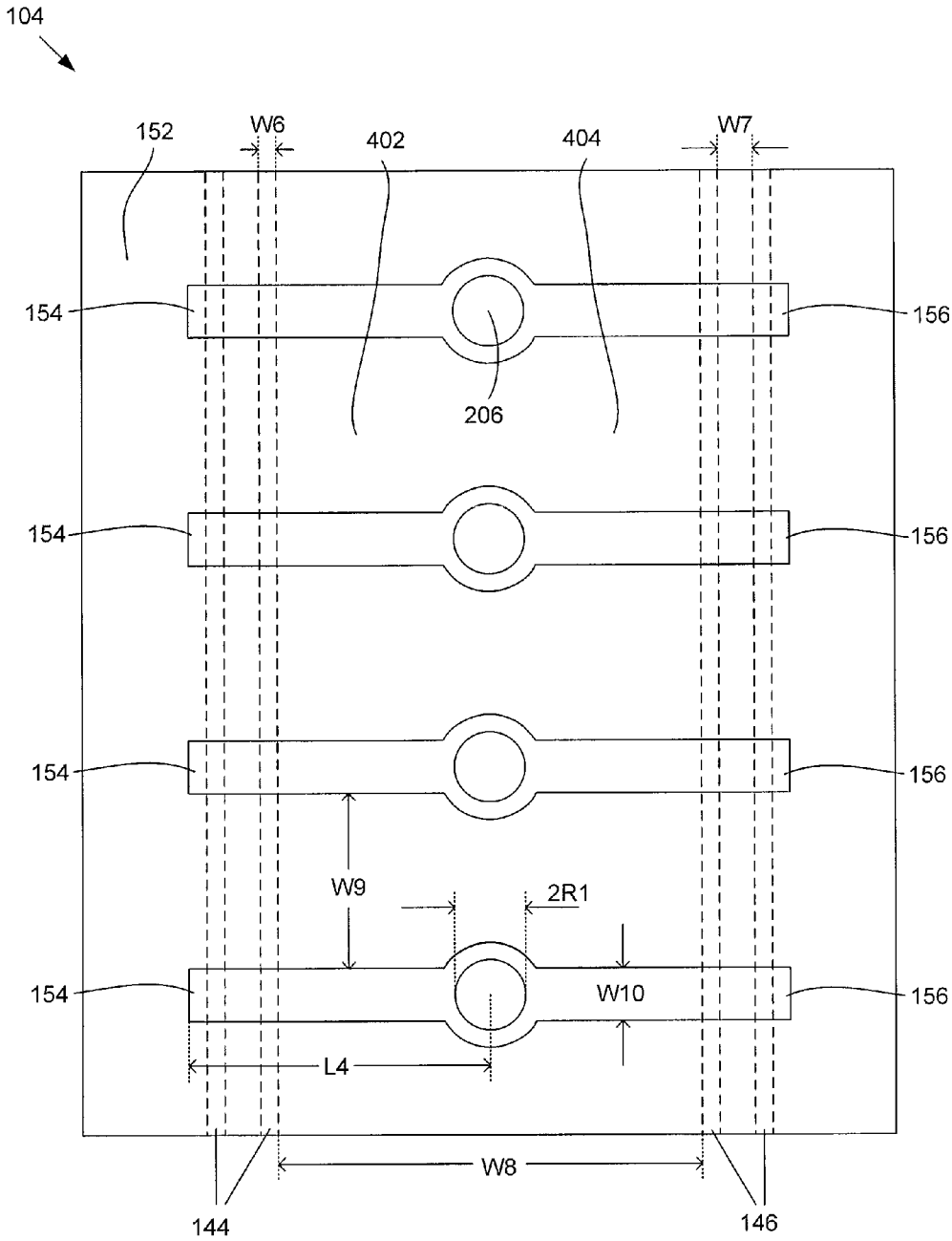
FIG. 4 illustrates a top view of a layer of an example multi-layer planar structure, showing an array of a plurality of quarter wavelength stubs.

FIG. 4 shows a top view of the third layer 108 of the apparatus 100 shown in FIG. 1, showing the quarter wavelength stubs 154 and quarter wavelength stubs 156, affixed to the substrate sub-layer 152. Each quarter wavelength stub 154 and quarter wavelength stub 156 may have the same or substantially the same dimensions and/or be symmetrical to each other. Additionally, where there are two differential transmission lines 144, 146 as shown in FIG. 1, each quarter wavelength stub 154 may have an opposing quarter wavelength stub 156. A quarter wavelength stub 154 may be connected to its opposing quarter wavelength stubs 156 by both being connected to a common via 206. Each quarter wavelength stub 154, 156 may extend away from the via 206. The quarter wavelength stubs 154 may extend in a direction that is opposite the direction that the quarter wavelength stubs 156 extend. In addition, the quarter wavelength stubs 154, 156 may extend away from the via 206 in a direction that is perpendicular to the direction in which the differential transmission lines 144, 146 extend.

Each of the quarter wavelength stubs 154, 156 may be defined and/or characterized by a length L4 extending from the via 206 to an end of the stubs 154, 156. The quarter wavelength stubs 154, 156 may also be defined by a width W10. The length L4 and the width W10 may be determined by the frequency of the second frequency component to be suppressed, and may be determined based on other characteristics and/or properties of the third layer 102, such as the dielectric constant and thickness of the substrate sub-layer 152. In addition, quarter wavelength stubs 154, 156 may be separated by adjacent quarter wavelength stubs 154 by gap 402, 404 having a width W9. Each quarter wavelength stub 154, 156 may have an associated input impedance. Additionally, two or more adjacent quarter wavelength stubs 154, 156 may have associated mutual impedances.

In some example configurations, as shown in FIG. 4, the quarter wavelength stubs 154, 156 may each be configured to have the same dimensions and/or be configured to suppress the same second frequency component. In alternative example configurations, the at least one second frequency component may include multiple frequency components at different frequencies. Some of the quarter wavelength stubs 154, 156 may have different dimensions or be configured to suppress different frequencies than other of the quarter wavelength stubs 154, 156. For example, quarter wavelength stubs 154 may be configured to have different dimensions and/or suppress signals having different frequencies than quarter wavelength stubs 156. In addition or alternatively, some of the quarter wavelength stubs 154 may be configured to have different dimensions and/or suppress signals having different frequencies than other of the quarter wavelength stubs 154. Similarly, some of the quarter wavelength stubs 156 may be configured to have different dimensions and/or suppress signals having different frequencies than other of the quarter wavelength stubs 156. Various configurations are possible.

Figure 5:
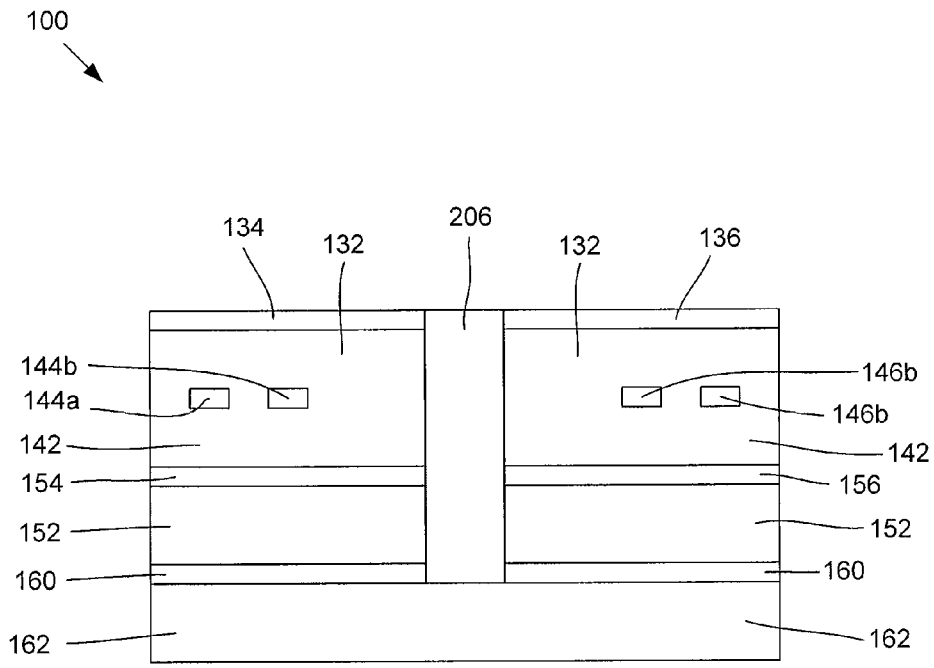
FIG. 5 illustrates a cross-sectional view of an example apparatus having a filter implemented in a multi-layer planar structure.

FIG. 5 shows a cross-sectional view of the apparatus 100 of FIG. 1, taken in cross-section at a mid-point of opposing EBG cells 134, 136 aligned with opposing quarter wavelength stubs 154, 156. FIG. 5 shows the via 206 connected to and extending from the EBG cells 134, 136, connected to and extending through the quarter wavelength stubs 154, 156, and connected to and extending to the ground reference 160. In addition, as shown in FIG. 5, differential traces 144*a*, 144*b* may be disposed in between EBG cells 134 and quarter wavelength stubs 154. The differential traces 144*a*, 144*b* may be separated by substrate sub-layers 132 and 142. Similarly, differential traces 146*a*, 146*b* may be disposed in between EBG cells 136 and quarter wavelength stubs 156. The differential traces 146*a*, 146*b* may be separated by substrate sub-layers 132 and 142. FIG. 5 also shows the ground reference plane 160 separated from the quarter wavelength stubs 154, 156 by substrate sub-layer 152.

Figure 6:
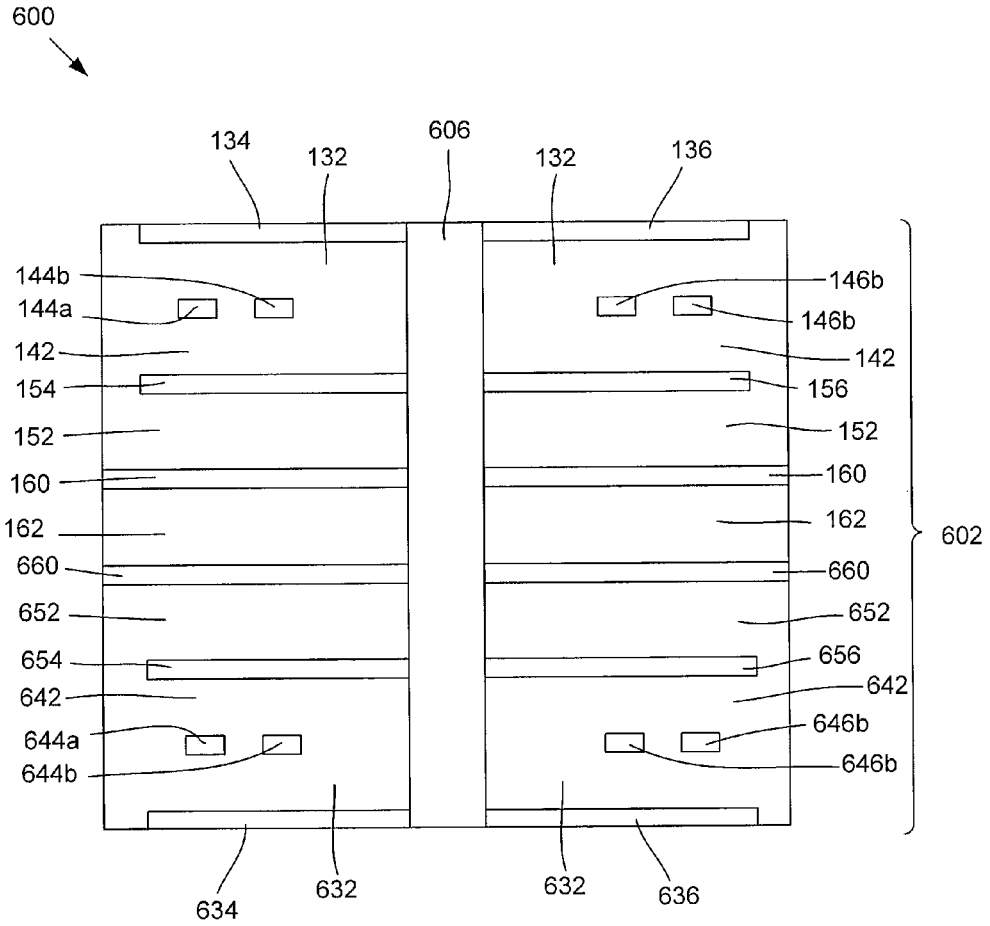
FIG. 6 illustrates a cross-sectional view of an example alternative apparatus having an alternative configuration of a filter implemented in a multi-layer planar structure.

FIG. 6 shows a cross-sectional view of an alternative example apparatus 600 that includes an alternative PCB filter 602. The alternative PCB filter 602 may include and/or be adapted for four differential transmission lines. In addition, the alternative PCB filter 602 may be similar to the PCB filter 102 in that it includes differential transmission lines 144, 146 disposed between and separated from the EBG cells 134, 136 and the quarter wavelength stubs 154, 156. The alternative PCB filter 602 may further include a third differential transmission line 644, including differential traces 644*a*, 644*b*. The third differential transmission line 644 may be disposed between EBG cells 634 and quarter wavelength stubs 654. The differential transmission line 644 may be separated from the EBG cells 634 and the quarter wavelength stubs 654 by substrate sub-layers 632 and 642, respectively. The alternative PCB filter 602 may also include a fourth differential transmission line 646, including differential traces 646*a*, 646*b*. The fourth differential transmission line 646 may be disposed between EBG cells 636 and quarter wavelength stubs 656. The differential transmission line 646 may be separated from the EBG cells 636 and the quarter wavelength stubs 656 by substrate sub-layers 632 and 642, respectively.

The EBG cells 634, 636 may be configured to suppress a third frequency component of signals being transmitted along the differential transmission lines 644, 646. In some example configurations, the third frequency component may be the same and/or have the same frequency as the first frequency component. Where the third frequency component is the same as the first frequency component, the EBG cells 634, 636 may be the same and/or have the same dimensions as the EBG cells 134, 136. In alternative example configurations, the third frequency component may be different and/or have a different frequency than the first frequency component. Where the third frequency component is different than the first frequency component, the EBG cells 634, 636 may be different and/or have different dimensions than the EBG cells 134, 136.

In addition, the quarter wavelength stubs 654, 656 may be configured to suppress a fourth frequency component of signals being transmitted along the differential transmission line 644, 646. In some example configurations, the fourth frequency component may be the same and/or have the same frequency as the second frequency component. Where the fourth frequency component is the same as the second frequency component, the quarter wavelength stubs 654, 656 may be the same and/or have the same dimensions as the quarter wavelength stubs 154, 156. In alternative example configurations, the fourth frequency component may be different and/or have a different frequency than the second frequency component. Where the fourth frequency component is different than the second frequency component, the quarter wavelength stubs 654, 656 may be different and/or have different dimensions than the EBG cells 134, 156.

In the alternative PCB filter 602, a via 606 may extend through all or at least some of the layers of the PCB. The via 606 may be connected extend from the EBG cells 134, 136 to the EBG cells 634, 636, and connect the EBG cells 134, 136, 634, 636 and the quarter wavelength stubs 154, 156, 654, 656 to the ground references plans 160 and 660. Additionally, in one example configuration as shown in FIG. 6, a substrate sub-layer 162 may separate the ground reference plane 160 from the ground reference plane 660. In alternative configurations, one of the ground reference planes 160, 660 may not be included, and the quarter wavelength stubs 154, 156 may be separated from the quarter wavelength stubs 654, 656 by a single ground reference plane (such as either ground reference plane 160 or ground reference plane 660) and two substrate sub-layers.

In one example implementation of the filter 602, the EBG cells 134, 136 and 634, 636 may be configured to suppress and/or attenuate 10 GHz signals, or a first harmonic of common mode noise associated with 10 Gb/s signals. Also, the quarter wavelength stubs 154, 156 and 654, 656 may be configured to suppress and/or attenuate 20 GHz signals, or a second harmonic common mode noise associated with the 10 Gb/s signals. In this example implementation, the EBG cells may be configured to have a length L1 of 1.85 millimeters (mm) and a width W1 of 1.55 millimeters. The width W2 of the inductive stripes and the gap widths W3, W4, and W5 may be the same and may be equal to about 0.1 mm. The width W6 of the traces of the transmission lines may be about 0.1 mm, and the minimal distance between the differential traces W8 may be about 2.5 mm. The length L4 of each of the quarter wavelength stubs may be about 1.7 mm and the width W10 of each of the quarter wavelength stubs may be about 0.25 mm. The gap W9 in between adjacent quarter wavelength stubs may be about 1.4 mm. The radius R1 of the vias may be about 0.125 mm, and the height $h_v$ of the vias may be about 0.1 mm.

The example PCB filters 102, 602 may improve and/or enhance suppression of unwanted signals, such as common mode noise, at first and second frequencies by combining a layer of EBG cells with a layer of quarter wavelength stubs configured to suppress signals at a second frequency in a stackup printed circuit board configuration. In some example configurations, the suppression of each of the first and second frequencies may be improved compared to filter configurations that are configured to suppress only one of the frequencies. In some configurations, the improvement may be on the order of 15-20 decibels (dB) or more. For example, a filter configuration that includes four EBG cells per transmission line, but does not include quarter wavelength stubs may attenuate the first frequency component by about 20-25 dB. In comparison, a filter configuration that has both four EBG cells per transmission line and four quarter wavelength stubs per transmission line, such as PCB filters 102 and/or 602, may attenuate the first frequency component by about 40 dB. Similarly, a filter configuration that includes four quarter wavelength stubs per transmission line, but does not include EBG cells may attenuate the second frequency component of signals by about 15-20 dB. In comparison, a filter configuration that has both four EBG cells per transmission line and four quarter wavelength stubs per transmission line, such as PCB filters 102 and/or 602, may attenuate the second frequency component by about 40 dB.

In some example configurations, for optimal performance, the quarter wavelength stubs and/or the layer of the multi-layer planar structure that has the quarter wavelength stubs may be placed or positioned in the multi-layer planar structure closer to the reference (ground) plane than the EBG cells and/or the layer of the multi-layer planar structure having the EBG cells. Similarly, the EBG cells and/or the layer of the multi-layer planar structure having the EBG cells may be placed or positioned in the multi-layer planar structure farther from the reference (ground) plan that the quarter wavelength stubs and/or the layer of the multi-layer planar structure that has the quarter wavelength stubs.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

The invention claimed is:

1. An apparatus comprising:

a filter comprising a multi-layer planar structure and a via extending in the multi-layer planar structure and connected to a ground reference plane, wherein the multi-layer planar structure comprises:

a first layer comprising an electromagnetic band-gap (EBG) structure, the EBG structure configured to suppress a first frequency component of signals passing through the filter;

a second layer comprising a quarter wavelength stub connected to and extending from the via, the quarter wavelength stub configured to suppress a second frequency component of the signals passing through the filter; and a third layer comprising a differential transmission line configured to transmit the signals passing through the filter.

2. The apparatus of claim 1, wherein the third layer comprising the differential transmission line is disposed in between the first layer and the second layer.

3. The apparatus of claim 1, wherein the via further electrically connects the EBG structure with the quarter wavelength stub.

4. The apparatus of claim 3, further comprising a fourth layer comprising the ground reference plane, wherein the via electrically connects the EBG structure and the quarter wavelength stub to the ground reference plane of the fourth layer.

5. The apparatus of claim 1, wherein the second layer comprises an array of quarter wavelength stubs, the array comprising the quarter wavelength stub, and wherein the EBG structure comprises an array of EBG cells.

6. The apparatus of claim 5, wherein the array of quarter wavelength stubs comprises four quarter wavelength stubs, and wherein the array of EBG cells comprises four EBG cells.

7. The apparatus of claim 1, wherein the differential transmission line comprises a first differential transmission line, wherein the EBG structure comprises a first EBG structure, and wherein the quarter wavelength stub comprises a first quarter wavelength stub, the first EBG structure and the first quarter wavelength stub each being associated with the first differential transmission line, wherein the third layer further comprises a second differential transmission line, wherein first layer further comprises a second EBG structure, wherein the second layer further comprises a second quarter wavelength stub, and wherein the second EBG structure and the second quarter wavelength stub are each associated with the second differential transmission line.

8. The apparatus of claim 7, wherein the first EBG structure and the second EBG structure are electrically connected to the via, and wherein the first quarter wavelength stub and the second quarter wavelength stub are connected to the via.

9. The apparatus of claim 1, wherein the EBG structure comprises a first EBG structure, wherein the quarter wavelength stub comprises a first quarter wavelength stub, and wherein the differential transmission line comprises a first differential transmission line, and wherein the multi-layer planar structure further comprises:

a fourth layer that comprises a second EBG structure configured to suppress the first frequency component;

a fifth layer that comprises a second quarter wavelength stub configured to suppress the second frequency component; and a sixth layer comprising a second differential transmission line configured to transmit the signals passing through the filter.

10. The apparatus of claim 1, wherein the first frequency component comprises at least one of a fundamental harmonic frequency or a second-order harmonic frequency of common-mode noise generated in the differential transmission line, and wherein the second frequency component comprises the other of the fundamental harmonic frequency and the second-order harmonic frequency.

11. The apparatus of claim 10, wherein the first frequency component comprises the fundamental harmonic frequency and the second frequency component comprises the second-order harmonic frequency.

12. The apparatus of claim 10, wherein the fundamental and second-order harmonic frequencies of common-mode noise are associated with a digital data rate of the signals passing through the filter.

13. The apparatus of claim 12, wherein the digital data rate is ten Gigabytes per second.

14. An apparatus comprising:

a band-stop filter configured to attenuate a first frequency component and a second frequency component of signals passing through the filter, the band-stop filter comprising a multi-layer printed circuit board that comprises:

a first layer comprising an electromagnetic band-gap (EBG) structure configured to suppress the first frequency component of the signals passing through the band-stop filter; and a second layer positioned substantially parallel with the first layer in the printed circuit board, the second layer comprising a quarter wavelength stub configured to suppress the second frequency component of the signals passing through the band-stop filter; and a via extending from the first layer to the second layer, the via electrically connecting the EBG structure with the quarter wavelength stub.

15. The apparatus of claim 14, wherein the signals comprise differential signals, the first frequency component comprises one of a fundamental harmonic frequency and a second-order harmonic frequency of common-mode noise associated with the differential signals passing through the filter, and wherein the second frequency component comprises the other of the fundamental harmonic and the second-order harmonic frequency.

16. An apparatus comprising:

a band-stop filter comprising a multi-layer printed circuit board that comprises:

an array of electromagnetic band-gap (EBG) cells disposed on a first layer of the printed circuit board;

an array of quarter wavelength stubs disposed on a second layer of the printed circuit board; and at least one differential transmission line disposed in between the array of EBG cells and the array of quarter wavelength stubs; and a plurality of vias, each via connecting one of the EBG cells in the array of EBG cells with one of the quarter wavelength stubs in the array of quarter wavelength stubs.

17. The apparatus of claim 16, wherein the array of EBG cells comprises four EBG cells per differential transmission line, and wherein the array of quarter wavelength stubs comprises four quarter wavelength stubs per differential transmission line.

18. The apparatus of claim 16, wherein the array of EBG cells is configured to attenuate a fundamental harmonic of common-mode noise generated in the at least one differential transmission line and the array of quarter wavelength stubs is configured to attenuate a second-order harmonic of common-mode noise generated in the at least one differential transmission line.

* * * * *